US009246207B2

(12) United States Patent
Smith et al.

(10) Patent No.: US 9,246,207 B2
(45) Date of Patent: Jan. 26, 2016

(54) ANTENNA AIMING SYSTEM AND METHOD FOR BROADBAND WIRELESS ACCESS

(75) Inventors: Anthony H. Smith, West Lafayette, IN (US); Lonnie D. Bentley, West Lafayette, IN (US); Michael D. Kane, West Lafayette, IN (US); Raymond A. Hansen, West Lafayette, IN (US)

(73) Assignee: Purdue Research Foundation, West Lafayette, IN (US)

( * ) Notice: Subject to any disclaimer, the term of this patent is extended or adjusted under 35 U.S.C. 154(b) by 2658 days.

(21) Appl. No.: 11/534,089

(22) Filed: Sep. 21, 2006

(65) Prior Publication Data

US 2007/0066233 A1 Mar. 22, 2007

Related U.S. Application Data

(60) Provisional application No. 60/719,365, filed on Sep. 22, 2005.

(51) Int. Cl.
*H01Q 1/12* (2006.01)
*H01Q 3/08* (2006.01)

(52) U.S. Cl.
CPC ..... *H01Q 1/1257* (2013.01); *H01Q 3/08* (2013.01)

(58) Field of Classification Search
CPC ..... H01Q 3/02; H04B 17/12; H04B 7/082
USPC ..... 455/63.4, 67.11
See application file for complete search history.

(56) References Cited

U.S. PATENT DOCUMENTS

| | | | | |
|---|---|---|---|---|
| 4,841,303 | A | 6/1989 | Anderson | |
| 5,089,825 | A | 2/1992 | Suzuki | |
| 6,023,247 | A | 2/2000 | Rodeffer | |
| 6,037,913 | A * | 3/2000 | Johnson | 343/882 |
| 6,049,306 | A | 4/2000 | Amarillas | |
| 6,188,300 | B1 | 2/2001 | Rodeffer | |
| 6,381,462 | B1 | 4/2002 | Charas | |
| 6,498,939 | B1 | 12/2002 | Thomas | |
| 6,556,808 | B1 * | 4/2003 | De La Chapelle et al. | 455/12.1 |
| 6,657,589 | B2 * | 12/2003 | Wang et al. | 342/383 |
| 6,816,121 | B1 | 11/2004 | Cheng et al. | |
| 6,816,706 | B1 | 11/2004 | Hohnstein et al. | |
| 6,831,610 | B2 | 12/2004 | Quagliaro | |
| 2003/0086386 | A1 * | 5/2003 | Tillotson | 370/321 |
| 2003/0214914 | A1 | 11/2003 | Cain | |
| 2003/0214969 | A1 | 11/2003 | Cain et al. | |
| 2004/0032847 | A1 | 2/2004 | Cain | |
| 2004/0053634 | A1 * | 3/2004 | Gainey et al. | 455/522 |
| 2004/0209574 | A1 * | 10/2004 | Tsay et al. | 455/67.14 |
| 2005/0113032 | A1 * | 5/2005 | Adam | 455/67.11 |

FOREIGN PATENT DOCUMENTS

WO WO 03/094287 A1 11/2003

OTHER PUBLICATIONS

DirecTV Installation Manual (c) 2003 pp. 4 and 9. DSS Owners Manual.*

(Continued)

*Primary Examiner* — Joshua Schwartz
(74) *Attorney, Agent, or Firm* — Faegre Baker Daniels LLP

(57) ABSTRACT

A system and method are provided for automatically aiming an antenna to communicate with a remote broadband wireless communication device.

4 Claims, 7 Drawing Sheets

(56) References Cited

OTHER PUBLICATIONS

Sony DirecTV High Definition Receiver/HDTV Recevier. (c) SonySatelliteManual.*
SonyT616 Camera Phone User's Guide p. 53.*
cdma2000 System for Mobile Communications, Vanghi, Damnjanovic, and Vojcic, (c) 2004, p. 374.*
DirecTV Car Antenna, 2005, p. 1.*
Search Report and Written Opinion for PCT/US06/37091 issued by ISA/US on Mar. 18, 2008.

* cited by examiner

ANTENNA AIMING SYSTEM AND METHOD FOR BROADBAND WIRELESS ACCESS

CROSS REFERENCE TO RELATED APPLICATION

This application claims the benefit of U.S. Provisional Application Ser. No. 60/719,365, filed on Sep. 22, 2005, which is expressly incorporated by reference herein.

BACKGROUND AND SUMMARY OF THE INVENTION

The present invention relates to an antenna aiming system for facilitating wireless communication between wireless network devices. More particularly, the present invention facilitates identifying a particular signal being transmitted by a wireless communication device and then automatically adjusting the position of a receiving antenna to improve connectivity between wireless network devices.

Broadband Wireless Access (BWA) is a technology that uses radio frequency signals to provide network connectivity either between two points (sometimes called "backhaul") or in a point to multi-point configuration that provides multiple users connectivity based on a wireless connection to a central device or access point. These wireless links typically either provide a high throughput connection to the Internet (usually over 2 Mbps), or access to other traditional computer networks without using wired connections.

The antennas used to provide the communication links between the BWA devices fall into two main categories. A first category is an omni-directional antenna which radiates in all directions. The second category is a directional antenna which is pointed in one direction and includes a concentrated signal beam. Omni-directional antennas do not need to be aimed, since they generally provide 360 degrees of coverage. However, omni-directional antennas provide a small coverage area, typically of only about 3-4 miles. Directional antennas can cover much longer distances, such as, for example, about 40 miles. However, the directional antennas must be aimed in order to establish a communication link. Typically, such aiming is done manually. Often an operator must climb a tower to adjust the antenna in order to receive the desired signal.

The present invention provides an automated aiming device that combines the best characteristics of both the omni-directional antenna and the directional antenna for use with BWA devices. The present invention automatically aims a directional antenna to maximize strength of the signal received from the transmitting antenna. The present invention can be used with two stationary antennas or with remote mobile antennas at a much greater distance than conventional omni-directional antennas. Therefore, the present invention permits coverage over larger areas, without the requirement of manually aiming the antennas.

The illustrated embodiments of the present invention provide a system for initializing and maintaining a functional radio connection between two or more BWA devices. Examples of such devices include, but are not limited to, the Motorola Canopy™ system, IEEE 802.16 standards based equipment, and IEEE 802.11 systems. In an illustrated embodiment of the invention, the aiming system uses a stepper and/or servo motor mechanism to manipulate the position and direction of the antenna relative to a transmitter such as an Access Point (transmitter/receiver supporting connectivity to multiple subscriber units) and/or a Subscriber Unit (client-end transmitter/receiver). The system includes software (or other electronic control system) that receives, evaluates, and responds to a radio signal, thereby automatically orienting the wireless connection points for broadband wireless communication. Functionally, the illustrated system includes an antenna mounted on or in a device that may mechanically reposition the antenna for the purposes of initializing and maintaining broadband wireless communication. The system also includes a software (or electronic) control process that monitors the strength and quality of antenna reception (as a function of the fixed or variable position of the antenna) and responds by positioning or repositioning the antenna to initialize and/or maintain broadband wireless communication.

In one illustrated embodiment, the system for initializing and maintaining a functional connection between two or more BWA devices receives input from the radio device via the audible tone jack that is present on the radio device, via a Simple Network Management Protocol (SNMP) interface on the radio device, via a "Screen Scraper" utility used to pull information from the configuration utility on the radio devices, or via some combination of these methods. In this embodiment, the system first alters the position of the antenna while monitoring the signal strength of a distant transmitter until the optimal antenna position has been identified (or all possible antenna positions have been surveyed), then uses this information to position the antenna for broadband wireless communication. Maintenance of the broadband wireless communication involves occasionally or persistently monitoring signal strength and then repositioning the antenna to facilitate constant broadband wireless communication. In the absence of radio signal, or if the signal is disrupted, the aiming system continues to alter the position of the antenna while monitoring the signal strength of a distant transmitter until the optimal antenna position has been identified (or all possible antenna positions have been surveyed). The aiming system then uses this information to position the antenna for broadband wireless communication. Other embodiments may include the use of other radio-direction support such as magnetometers, or GPS receiver assistance, or a combination of these technologies, as well as the utilization of algorithms (or other dedicated control systems) that project future optimal position(s) of the antenna based on changes in signal strength location(s).

The system for initializing and maintaining a functional connection between two or more BWA devices automatically aims the antenna devices, without direct human intervention, that cover a range that requires use of a directional antenna. This aiming includes, but is not limited to moving the antenna device rotationally (horizontally or azimuth) and/or vertically (elevation), as well as the ability to change the location of the entire aiming system and antenna, or any combination thereof.

The system of the present invention may be used in many distinct classes of operation, in all of which BWA connectivity is used to provide wireless network connections to a location that then provides wired access connectivity to the Internet or other network resources. Illustratively, the aiming system of the present invention may be used for:

(1) initializing and maintaining a functional connection with stationary aiming of devices on towers or high-sites (often called back hauls);

(2) initializing and maintaining a functional connection with manned or unmanned vehicles that are in constant or occasional motion including, but not limited to seafaring, aviation, terrain, recreation, agriculture and military vehicles;

(3) initializing and maintaining a functional connection with low-mobility applications that require that a mobile vehicle such as a tractor, boat, or military vehicle which need to be tracked from a distance as they move; and (4) high-mobility applications where a vehicle or aircraft must be tracked from a distance, possibly acting as a repeater to provide "down-beam" wireless network connectivity.

In addition, a system for initializing and maintaining a functional connection between two or more BWA devices will support communications with vehicles, devices and/or detectors positioned in or on unstable or dynamic hydrological or geological terrains including, but not limited to, lava flows, tidal pools, fault lines, mud slides, icebergs, glaciers, and aquatic surfaces.

In an illustrated embodiment, a method is provided for aiming an antenna to permit communication with a remote broadband wireless communication device. The method includes moving the antenna along a path, determining a signal quality value of a signal transmitted by the broadband wireless communication device and received by the antenna at a plurality of different locations along the path, storing the determined signal quality values and the associated antenna coordinates, selecting an optimal antenna position based on the stored signal quality values and the associated antenna coordinates, positioning the antenna at the selected optimal antenna position, and establishing a communication session between the antenna and the remote broadband wireless communication device.

The illustrated method further includes determining whether a trigger event has occurred, moving the antenna along an optimization scan path in an area adjacent the optimal antenna position upon occurrence of the trigger event, determining a signal quality value of a signal transmitted by the broadband wireless communication device and received by the antenna at a plurality of different locations along the optimization scan path, determining whether a new optimal antenna position exists based the signal quality values along the optimization scan path, and positioning the antenna at the new optimal antenna position upon determining that a new optimal antenna position exists.

In another illustrated embodiment, a method is provided for aiming an antenna to communicate with a broadband wireless communication device. The method includes using a first antenna including a receiver to determine an optimal antenna position by monitoring a signal quality value of a signal transmitted by the broadband wireless communication device and received by the first antenna at a plurality of different locations along a scanning path of the first antenna, positioning a second antenna including a receiver and a transmitter at the optimal antenna position, and establishing a communication session between the second antenna and the broadband wireless communication device.

In an illustrated embodiment, the step of using a first antenna including a receiver to determine an optimal antenna position includes moving the first antenna along a path, determining a signal quality value of a signal transmitted by the broadband wireless communication device and received by the first antenna at a plurality of different locations along the path, and selecting the optimal antenna position based on the signal quality values and the associated first antenna coordinates determined in the determining step. The illustrated method further includes continuously repeating the moving, determining and selecting steps to determine whether a new optimal antenna position exists during the communication session between the second antenna and the broadband wireless communication device, and moving the second antenna to the new optimal antenna position if the optimal antenna position has changed.

In another illustrated embodiment, a system is provided for aiming an antenna to communicate with a broadband wireless communication device. The system includes an antenna, a drive mechanism coupled to the antenna, and a controller coupled to the drive mechanism. The controller is configured to actuate the drive mechanism to move the antenna along a path. The controller includes means for determining a signal quality value of a signal transmitted by the broadband wireless communication device and received by the antenna at a plurality of different locations along the path, means storing the determined signal quality values and the associated antenna coordinates, means for selecting an optimal antenna position based on the stored signal quality values and the associated antenna coordinates, means for positioning the antenna at the selected optimal antenna position, and means for establishing a communication session between the antenna and the remote broadband wireless communication device.

Additional features of the present invention will become apparent to those skilled in the art upon consideration of the following detailed description of illustrative embodiments exemplifying the best mode of carrying out the invention as presently perceived.

BRIEF DESCRIPTION OF THE DRAWINGS

The detailed description of the drawings particularly refers to the accompanying figures in which.

DETAILED DESCRIPTION OF THE DRAWINGS

Figure 1:
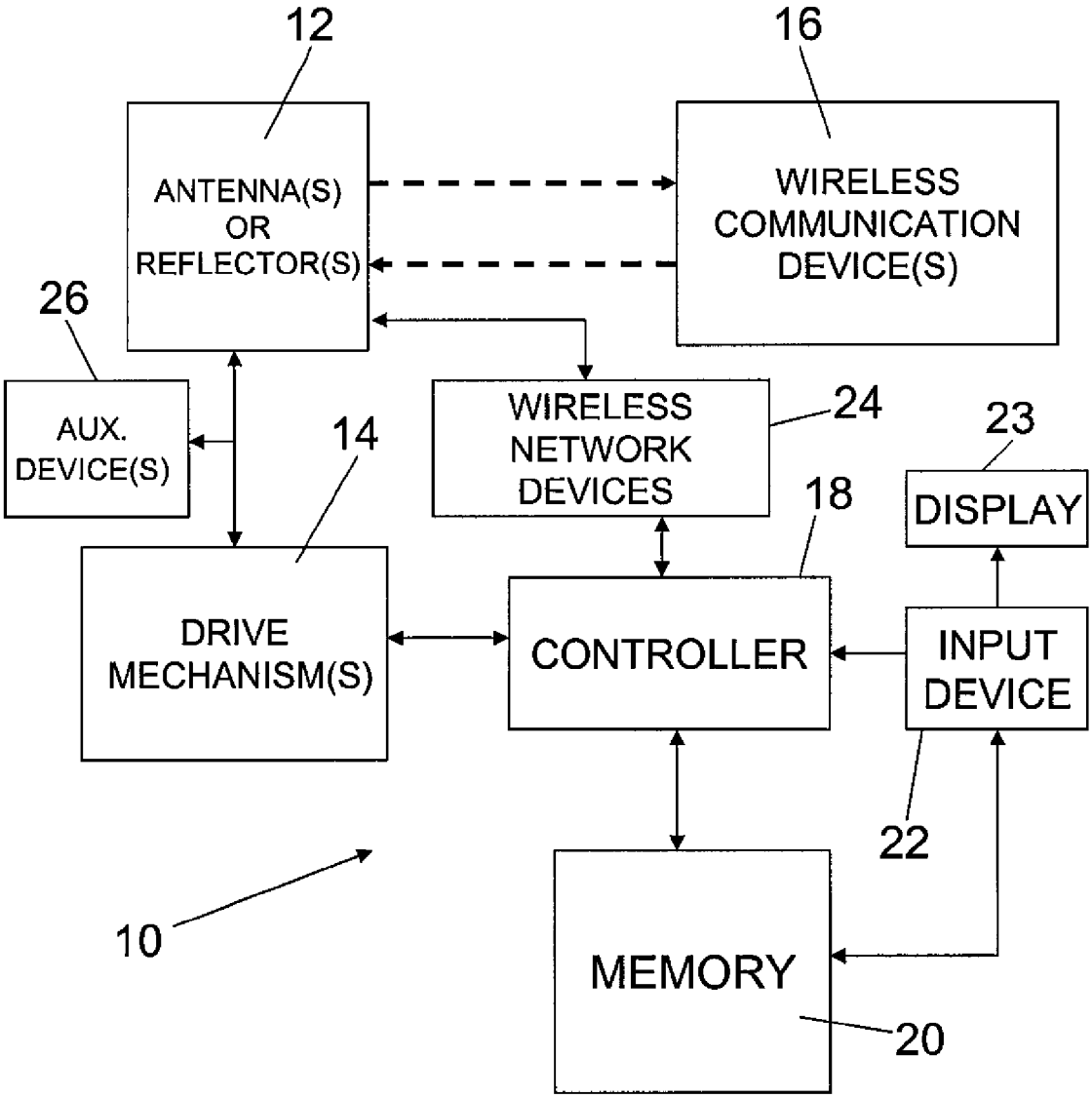
FIG. 1 is a block diagram of the antenna aiming system of the present invention.

Referring now to the drawings, FIG. 1 illustrates an antenna aiming system 10 of the present invention. The antenna aiming system 10 is illustratively coupled to an antenna or reflector 12. In an illustrated embodiment, a drive mechanism 14 is coupled to the antenna to move to an antenna 12 about a horizontal axis and vertical axis to position the antenna to optimize signal parameters received from a wireless communication device 16. A controller 18 is coupled to the drive mechanism 14 to control movement of the antenna 12 as discussed in detail below. For example, controller 18 may be a programmable logic controller (PLC). The controller 18 is coupled to a memory 20 which stores data related to the detected signal and coordinates of the antenna as discussed below.

Figure 2:
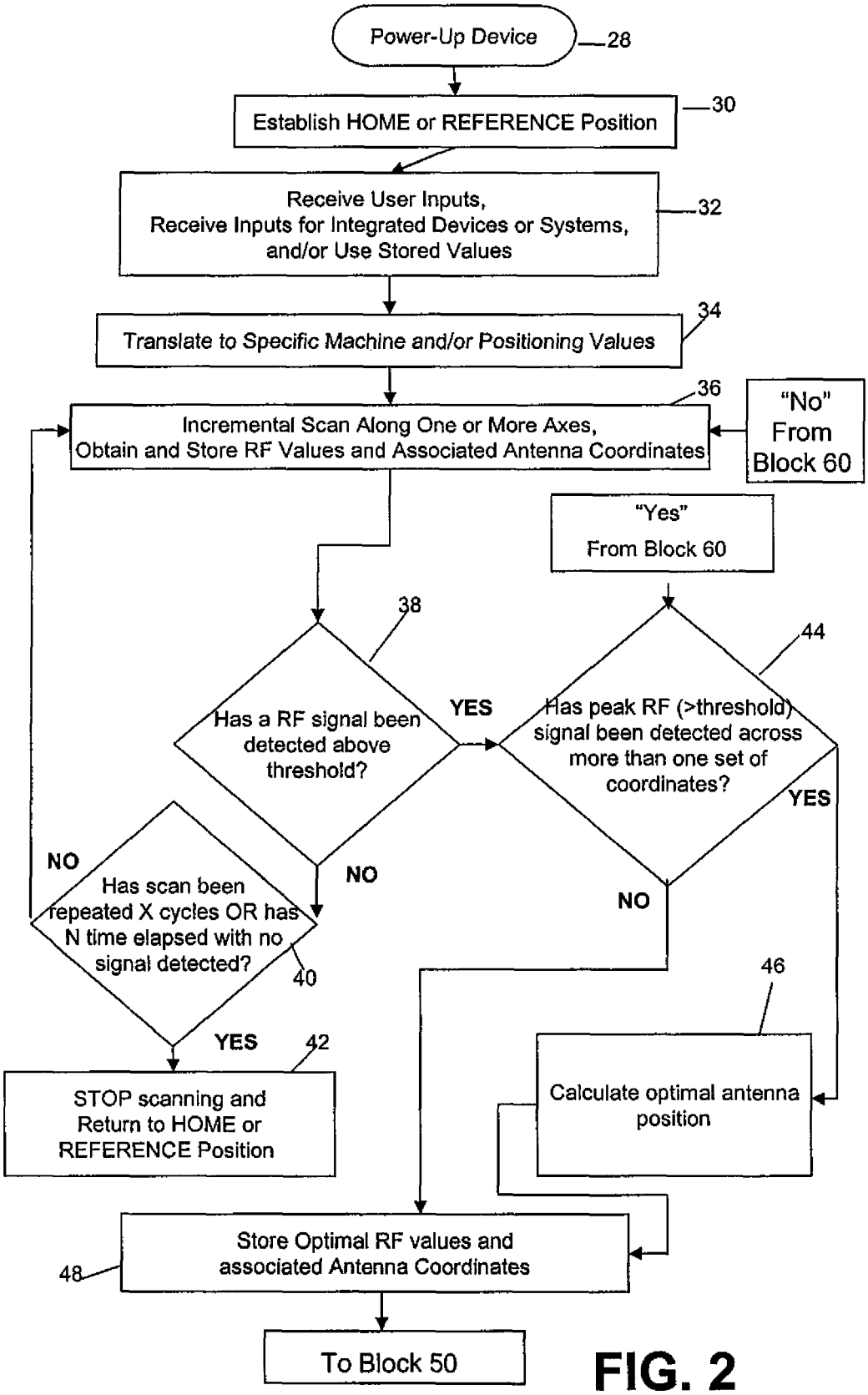
FIGS. 2 and 3 are a flow-chart illustrating the steps performed to automatically aim the antenna.

FIG. 2 illustrates the steps performed by an illustrated embodiment of the antenna aiming system 10. First, the system is powered-up as illustrated at block 28. Next, controller 18 moves the antenna 12 to its neutral, home or reference position on each axis as illustrated at block 30. The home or reference position is illustratively any desired known starting position for the antenna 12 on each axis. The controller 18 then receives user inputs to set system specifications from an input device 22 as illustrated at block 32. The input device 22 and memory 20 may be a laptop computer or a hand held computing device, for example. A display 23 is coupled to the input device 22. A user interface (UI) may be integrated with existing map, topology and/or positional softwares/firmwares/middlewares to allow for visual representation of identification of potential target communication devices 16 in relationship to the antenna 12.

In an illustrated embodiment, a laptop computer provides the user input/display and controller interfacing. It is understood that a pocket PC or other type of small computer device may be used. In an illustrated embodiment, the user may specify the following items at block 32:

1. minimum and maximum rotational speed for antenna;
2. the total distance to be scanned;
3. the distance (step increments) the antenna will move between measurements to be taken; and
4. the number of horizontal planes to be scanned (including the degrees between those scans).

It is understood, however, that the user may specify other operational parameters. The system 10 also receives inputs from integrated devices and systems such as transponders, transceivers, cameras, lasers, scientific measurement apparatus, marine command and control systems, and other devices or systems that can supply directional information for purposes of aiming or moving the antennas.

In addition, the system may be pre-programmed to use values stored in memory 20 and not permit the user to select or adjust the specifications as further illustrated at block 32.

Next, controller 18 translates the user input values into machine specific values and/or positioning values for controlling the drive mechanism 14 as illustrated at block 34. Controller 18 then controls drive mechanism 14 to begin an incremental scan of the antenna 12 along one or more selected axes as illustrated at block 36. Illustratively, the controller 18 moves the antenna 12 a certain number of degrees along a first axis and then stops and takes a signal reading. The controller may look for a predetermined signal identifier identifying the particular wireless communication device 16 of interest as part of obtaining the signal. Alternatively, the controller 18 may store RF signal values and signal identifiers for all deleted signals. A RF value is then calculated and stored in memory 20 along with the associated antenna coordinates at each of the incremental positions of the antenna 12 as illustrated at block 36. The scanning pattern is illustratively antenna specific depending upon the wavelength and beam width of the antenna and on the gain and directionality of the antenna. Different scanning patterns may be used depending upon the particular application such as marine applications, agricultural applications, aviation applications, and stationary point to point applications.

The directional and positional pattern that the device follows during a scan may vary in both rate and dimension. For example, initiation of the device may involve a relatively fast scan across horizontal and/or vertical directions simply to identify course directions or coordinates where a transmitting signal is located. Once a transmitting signal has been located, a subsequent scan can be utilized using smaller incremental changes in antenna positioning to identify the optimal coordinates for wireless communication. Once the network session has been established and if a decrease in the signal strength below a threshold is detected (e.g. if one of the antennas is located on a vehicle in motion), a scan can be initiated that is limited to the coordinates nearest the previous optimal communication coordinates, rather than surveying the entire landscape (i.e. it is expected that the "next" optimal antenna position is very close to the "previous" optimal location). The method for determining which scan pattern to utilize can be determined by the rate at which signal strength is decreasing, and the time intervals between a series of signal decreases below threshold. For example, if signal strength decreases quickly, a scan of more coordinates (i.e. a larger search area) may be needed to maintain a network session. In addition, once the distance between the two antennas is determined (obtained during the network session) one or more search pattern(s) can be utilized. If the distance between the antenna is great (e.g. >10 statute miles) when the device is mounted on a marine vessel (i.e. slow moving vehicle), then a smaller search pattern may be utilized to optimize communication performance, once the signal strength has decreased below threshold. Similarly, moving vehicles that harbor the device that are close to the communication antenna (e.g. <1 statute mile) may require a larger search pattern upon decreased signal detection. The ability to integrate vehicle speed and/or direction can also dictate search patterns, where a vehicle moving at 40 miles per hour moving north can be integrated into the search pattern methodology to (1) indicate where the device "next" searches for an optimal signal and/or (2) predict where the "next" optimal signal will be detected, and reposition the antenna to the appropriate position/location.

Tracking or scanning speed of the antenna depends upon antenna capability. Different methods of search pattern optimization may be used during the scan. For example, if a tested speed for scanning works for a particular application, the system will learn and keep using that speed. Different scanning speeds are also selected based on operating conditions and/or movement.

In an illustrated embodiment, the controller 18 uses a signal quality parameter and/or other signaling methodologies including, but not limited to, frames, time slots, color codes, frequency, channels, polarization and/or service set identifier (SSID) to locate a target source wireless broadband signal. The software allows a user to identify the signal to be targeted and then scans the horizon and elevation for the signal identifier corresponding to the target signal. The controller 18 measures and stores signal strength and signal quality and stores these parameters at each of the antenna coordinates during the incremental scan to create an accessible database in memory 20.

The scanning path at block 36 may be an expanding square, sweeping the horizon, a logarithmic scan based on distance, or other scanning pattern based upon the particular application and antenna characteristics. Controller 18 determines whether a RF signal has been detected above a pre-determined RF value threshold level as indicated at block 38. If not, controller 18 determines whether the scan has been repeated for a pre-determined number of cycles or whether a predetermined time has elapsed with no signal being detected as illustrated at block 40. The scan has been repeated a predetermined number of cycles or a predetermined time period has lapsed, controller 18 stops scanning and returns to the home or reference position as illustrated at block 42. If the scan has not repeated a predetermined number of times or if the predetermined time period has not elapsed at block 40, controller 18 returns to block 36 and performs another incremental scan.

A signal quality is typically used to determine the optimal RF value. Every type of equipment and every vendor typically has their own method of assessing an acceptable signal quality or link quality. An appropriate formula must be determined for each individual equipment supported or used. Therefore, it is understood that various formulas may be used depending on the instruments or vendors used to measure link quality.

There are many parameters which can be used to determine the threshold value for determining system action. Each of these parameters will dictate the level at which a threshold decision is made by the system. These parameters are listed, but not limited to, Received Signal Strength Indication (RSSI), Signal to Noise Ratio (SNR), Bit Error Rate (BER), noise floor, signal output power/signal strength, signal modulation scheme/technique, signal phase, jitter, signal delay, signal skew, and available time, frequency, &/or code slots. Based on the available reportable parameters available in any specific wireless networking &/or communication system, a determination for threshold values will be made that incorporates any combination of those specified parameters.

In an illustrated embodiment of the present invention, the formula for determining the RF value for a Motorola Canopy system uses two parameters to calculate the RF value. The first parameter is Received Signal Strength Indication (RSSI). RSSI is a measurement of the strength (not necessarily the quality) of a received signal strength in a wireless environment, in arbitrary units. A RSSI value is provided by measuring the signal strength of a wireless network through the use of a wireless network monitoring tool available from many sources. RSSI measurements and units vary greatly depending on the vendor. For example, network interface cards available from Cisco Systems® may return a RSSI value between 0 and 101, where 0 indicates no signal, 1 indicates the minimum signal strength detectable by the wireless card, and 101 indicates the maximum value. Network interface cards available from Intel® on the other hand report a logarithmic measurement of the RSSI, with values ranging from approximately −35 (very strong signal) to about −95 (very low signal). RSSI measured by the Motorola Canopy system will range from 0-4000, with an acceptable recommended minimum of 700 for a viable link.

The second parameter used to calculate the RF value at block 38 is "jitter". Jitter is a factor that relates to uncertainty or variability in a signal's timing. Jitter can be measured using conventional devices such as, for example, the Motorola Canopy system in which jitter will range from 0-15, with an acceptable limit generally being less than 5. The highest RSSI can be achieved with the lowest jitter. The present invention controls the position of the antenna 12 to maximize RSSI while minimizing jitter. In the illustrated embodiment, the RF value is calculated according to the following formula:

$$RF\ \text{value} = \frac{RSSI^2}{\text{Jitter}}$$

As discussed above, it is understood that other calculations made be used to obtain an RF value for controlling the antenna. The formula shown above for RF value is specific to Motorola Canopy system.

If an RF signal above the threshold value was detected at block 38, controller 18 determines whether a peak RF value greater than the threshold has been detected at more than one set of coordinates during the scan as illustrated at block 44. If only one set of coordinates has the peak RF value greater than the threshold, those particular coordinates are stored as an optimal antenna position along with the measured RF value as illustrated at block 48. If more than one set of coordinates has the peak RF signal value greater than the threshold at block 44, the controller 18 calculates an optimal antenna position as illustrated at block 46. The controller 18 then stores the optimal RF values associated with antenna coordinates as for the optimal antenna position as illustrated at block 48.

The controller 18 illustratively calculates an optimal antenna position based on all the coordinates and corresponding stored RF values. For instance, a center position of the axial coordinates with RF values greater than the threshold value may be used as the optimal antenna position. For example, if maximal signal strength values are detected in the horizontal dimension between 45-degrees and 55-degrees (from a "home" position on the device), then the device will position the antenna at 50-degrees, which is at the center of the maximal signal strength region. This applies to the azimuth dimension as well.

Figure 3:
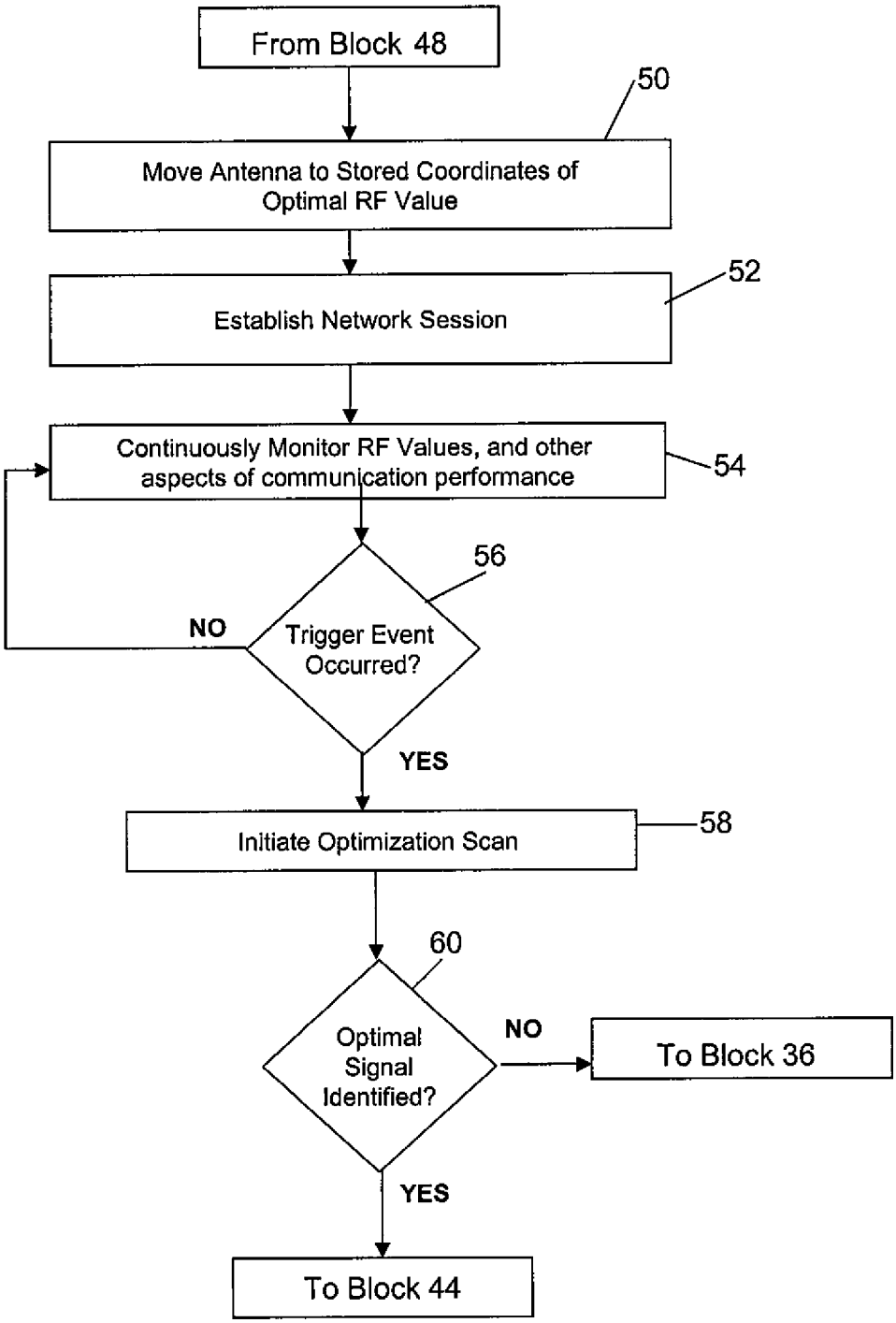

Next, the controller 18 moves the antenna 12 to the stored coordinates of the optimal RF value is illustrated at block 50 in FIG. 3. Controller 18 establishes a network communication session between the antenna 12 and the wireless communication device 16 using the wireless network devices 24 (see FIG. 1) as illustrated at block 52.

Controller 18 continuously monitors the RF values detected by antenna 12 along with other aspects of the communication performance discussed above as illustrated at block 54. Controller 18 determines whether a trigger event has occurred as illustrated at block 56. If not, the controller 18 continues to monitor the RF values at block 54. If a trigger event has occurred at block 56, controller 18 initiates an optimization scan as illustrated at block 58. The optimization scan at block 58 is illustratively a focused scan to measure RF valve signal strength at coordinates adjacent to the last optimal antenna position coordinates stored at block 48. Illustratively, scanning begins in a circular mode surrounding the last optimal antenna coordinates looking for improved signal strength or signal quality readings.

In one illustrated trigger event, the controller 18 determines whether the RF value of the detected signal has decreased below the threshold value. If not, controller 18 continues to monitor the RF values at block 54. If the RF value drops below the threshold value at block 56, controller 18 then runs the optimization scan as illustrated at block 58. The optimization scan may vary depending upon the particular application or antenna.

Controller 18 determines whether a new optimal signal has been identified during the optimization scan at block 60. If a new optimal signal has not been identified, controller 18 returns to block 36 of FIG. 2 to perform a full scan to obtain and store new RF values associated with antenna coordinates. If a new optimal signal is identified at block 60, controller 18 moves to block 44 of FIG. 2 to re-establish the optimal RF value and reposition the antenna 12.

In other illustrated embodiments, other trigger events may be used to cause controller 18 to perform an optimization scan at block 58 or a new complete search/scan at block 36. Illustrated trigger events include:

1. A decrease in signal strength below a threshold value—conduct focused optimization search as discussed above.

2. A loss of the signal—conduct a focused optimization search and/or a complete search.

3. Trigger after a pre-programmed time period has elapsed—conduct a focused optimization search. In an alternative embodiment, the system conducts a focused optimization search after a "learned" periods of time based on information obtained from prior uses of the system.

4. Actuation of a mechanical switch such as a mercury switch or other directional switch triggers conducting a focused optimization search or a complete search. A directional switch may also be based on a GPS signal or a magnetic north signal.

5. If the distance from the access point exceeds a predetermined distance—conduct a focused optimization search or complete search.

6. User prompted triggers—conduct a focused optimization search or complete search. The user may prompt the trigger using a switch or the input device 22.

7. Data traffic trigger. If the system detects a certain data rate or data type, the system may automatically switch to a new access point. For example, if the user initiates a VoIP session, the system will automatically switch to broadband connection by locating a suitable wireless communication device 16 and making a network connection.

Multiple Antenna Embodiment

In another illustrated embodiment, multiple antennas may be used to scan, acquire and track the wireless broadband signal. In this embodiment, a first antenna 12 is used to communicate with the remote wireless communication device 16. In other words, the first antenna includes both transmitter and a receiver components. A second antenna 12 may include only a receiver. Therefore, the second antenna 12 may be less expensive than the first antenna 12. In this embodiment, separate drive mechanisms 14 are provided for the first and second antennas.

The first antenna illustratively remains in communication with the wireless communication device 16 while the second antenna continuously scans for an optimal antenna position based on signal strength and/or signal quality. The second antenna provides feedback for adjusting the position of the first antenna. The second antenna continues scanning and populating the table or database of RF signal values and corresponding antenna coordinates.

Figure 4:
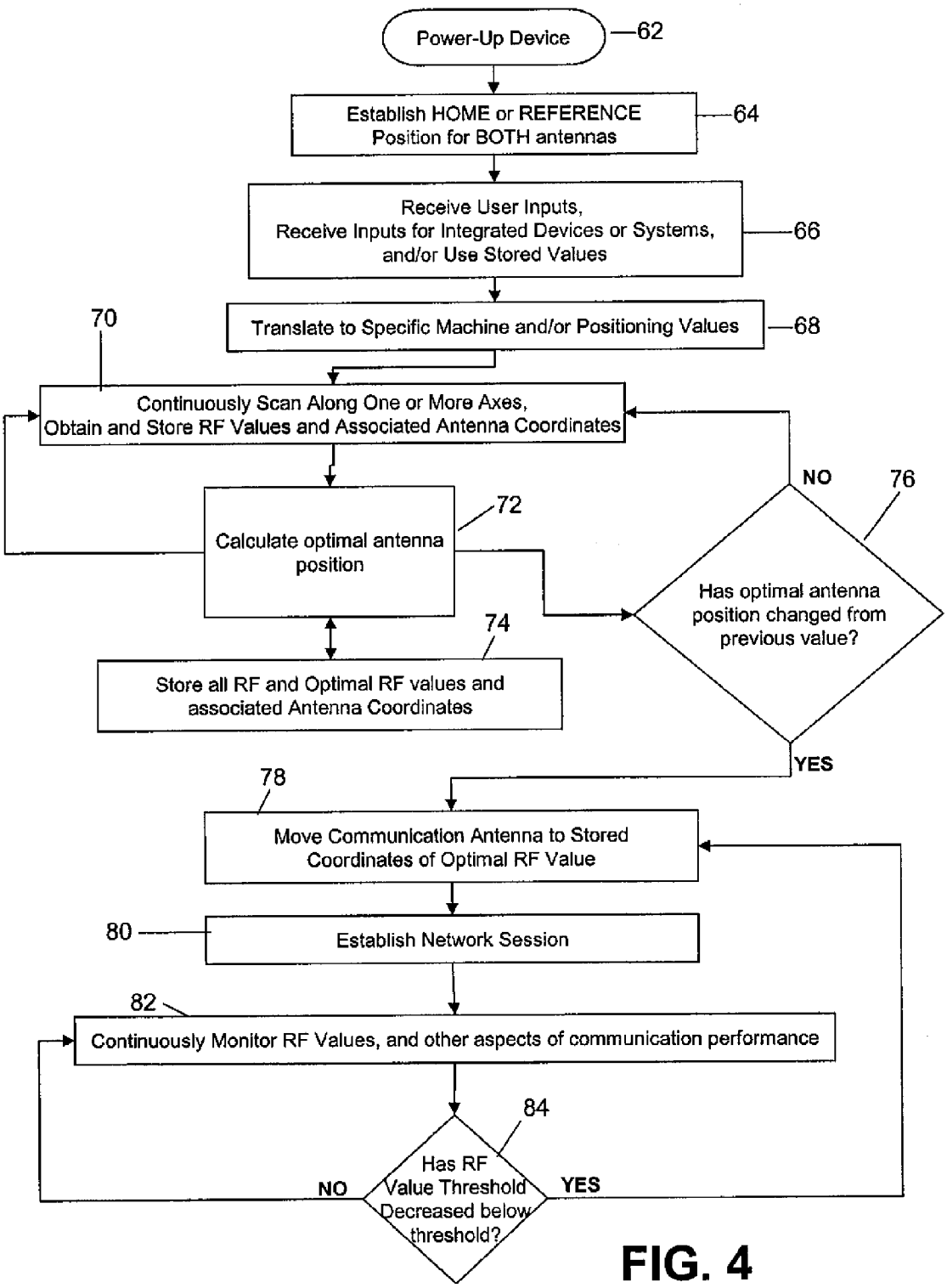
FIG. 4 is a flowchart illustrating steps performed by a system including a first antenna for communicating with a wireless communication device and a second antenna for determining an optimal antenna position.

FIG. 4 is a flowchart illustrating the steps preformed by the embodiment having first and second antennas. First, the system is powered-up as illustrated at block 62. Next, controller 18 moves the first and second antennas 12 to their neutral, home or reference position on each axis as illustrated at block 64. The home or reference position is illustratively any desired known starting position for the first and second antennas 12 on each axis. The controller 18 then receives user inputs to set system specifications from an input device 22 as illustrated at block 66. The input device 22 and memory 20 may be a laptop computer or a hand held computing device, for example. The system 10 also receives inputs for integrated devices and systems as discussed above. The system may be pre-programmed to use values stored in memory 20 and not permit the user to select or adjust the specifications as further illustrated at block 66.

Next, controller 18 translates the user input values into machine specific values and/or positioning values for controlling the drive mechanism 14 as illustrated at block 68. Next, the second antenna continuously scans along one or more axes and obtains and stores RF values and associated antenna coordinates as discussed above as illustrated at block 70. Controller 18 then calculates an optimal antenna position as illustrated at block 72 as also discussed above. For instance, the center of axial coordinates with RF values exceeding the threshold value may be used as the optimal antenna position. In another embodiment, the maximum RF value among the stored values may be used as the optimal antenna position.

Controller 18 stores all RF values and optimal RF values associated with antenna coordinates in the memory 20 as illustrated at block 74. Controller 18 determines whether the optimal antenna position has changed from a previously determined optimal location as indicated at block 76. If not, the second scanning antenna continues to continuously scan at block 70. If the optimal antenna position has changed from the previous optimal antenna position at block 76, the controller 18 moves the first communication antenna to the new optimal position coordinates corresponding to the optimal RF value as indicated at block 78. The first communication antenna then establishes or continues a network communication session with the wireless communication device 16 as illustrated at block 80. Controller 18 continuously monitors RF values and other parameters of the signal received by the first communication antenna as illustrated at block 82. If the detected RF value received by the first communication antenna decreases below a threshold value at block 84, controller 18 moves the communication antenna to a new stored optimal value at block 78. If the detected RF value from the communication antenna 12 has not decreased below the threshold value at block 84, the controller 18 continues to monitor the RF values and other aspects of communication performance at block 82.

It is understood that other trigger events discussed above may be used to cause repositioning of the first communication antenna. This embodiment advantageously permits one antenna to maintain communication with the wireless communication device while another antenna continually scans for optimal positions of the antenna. A cheaper receive only antenna may be used for the scanning antenna.

Object Locating and Tracking

In another embodiment of the present invention, the antennas 12 of the present invention are used to locate and track objects. For instance, transmitter tags such as RFID tags or RTLS tags may be placed on objects such as, for example, trailers located within a parking lot or items in a warehouse. By using at least two antennas positioned at different locations, the antennas can be used to detect the transmitted signal from a particular tag located on the object. The system then uses the data from the at least two antennas to determine the particular location of the item, such as a trailers in the lot or an item in the warehouse.

Auxiliary Devices

In another embodiment of the present invention, auxiliary devices 26 may be coupled to the antennas, a housing and or other mounting structure and controlled by drive mechanisms 14. The auxiliary devices 26 are illustratively cameras, microphones, lasers, munitions, sensors and/or detection devices which work independently from the antennas. The auxiliary devices may be controlled from a remote input device coupled to wireless communication device 16. For instance, the remote location may send instructions to move a camera and then instruct controller 18 to send the camera signal through the transmitter of antenna 12 back to the wireless communication device 16.

Multi-Mode Devices

Other wireless or cellular devices may be coupled to the antennas, a housing and or other mounting structure and controlled by drive mechanisms 14. For applications that spend time in an existing wireless broadband network, or begin in same, the software is capable of allowing networked devices to use the existing wireless network signal until such time as the signal strength and quality fades to a threshold point, derived independently by network. Once the threshold has been reached, the antenna aiming system 10 will have already acquired and began tracking a suitable wireless communication device 16 as discussed above, and will begin providing the network connectivity to allow for seamless, uninterrupted user sessions.

For applications that require access to multiple communications devices or systems, multiple antennas and radios can be mounted on the chassis providing access capability. For instance, a boater may use an existing WiFi connection provided from his marina. At the point when the vessel reaches the limit of the connection range for that system, the device is capable of switching communication modes to a secondary or tertiary antenna mounted on the same chassis. This would allow increased distance and/or varied access. This also allows for a scenario where the end user can control the communication utilizing a methodology of "least-cost-routing". This enables the user to pre-set the software to use the best signal in combination with the users preference for cost of acquisition of that signal. Further, an additional antenna may be used to find optional sources of communication and provide instruction to the main antenna radio combination for purposes of identifying alternate sources of communication as the vehicle transitions from one mode boundary to another.

Vehicles in Motion

The antenna aiming system 10 locates, optimizes, tracks and enables high bandwidth Internet access for vehicles in motion. The system 10 integrates positioning and communications software with a dedicated positioning chassis and drive mechanism (mounted on board a marine, terrestrial or aerial vehicle) to locate one or more Internet access points, optimize the position of the antenna for optimal communication with the access point, and track the access point as the vehicle changes position while in motion. This locate, optimize and track strategy allows wireless Internet access to extend miles beyond existing technologies and solutions, and enables vehicles (e.g. boats, trucks, tractors, aircraft, etc.) to establish and maintain high bandwidth (broadband) internet connections. If one or both the antenna 12 or the wireless communication device 16 is in motion, software on the controller 18 can analyze the measurements taken to determine the direction of movement. By determining a predicted path of movement, the controller 18 facilitates tracking of the signal. When the system is in motion, such as in a moving boat or vehicle or on a wave power generation system, the system accounts for movement of the overall system when storing coordinate values during the scan by setting reference coordinates. A GPS signal and/or mapping software may be used to assist aiming of the antenna 12, to predict movement and/or to assist in establishing the reference coordinates.

Using a "home" position the antenna accounts for movement against the position of "home" from the start of the scan cycle. Whether the source, client, or both are in motion the software records the values at the corresponding points as it relates to the "home" position and calculates accordingly. Further, through the use of auxiliary GPS devices, the "home" position may be set by latitude and longitude coordinates.

The antenna aiming system 10 allows a distant access point (antenna connected to the Internet) to be automatically located, establishes a wireless broadband network session, continuously optimizes the communication performance of the wireless broadband connection optimized while maintaining the network session, and continuously repositions the directional broadband antenna mounted on a terrestrial vehicle, marine vessel, or aircraft maintaining the wireless broadband network session. This vehicle "tracking" capability allows vehicles to maintain an uninterrupted broadband wireless network connection with a wireless network (or the Internet). This capability extends to all moving vehicles, and provides real-time, high bandwidth access to essentially all digital data types such as voice over internet protocol (VoIP), video conferencing, and video streaming. In addition, the antenna aiming system 10 can detect any wireless transmission within a 15-20 mile radius allowing the system 10 in a fixed position to connect to any wireless access point in the region.

The antenna aiming system 10 can utilize essentially any communication wavelength and directional antenna design, thereby allowing the technology to support any wireless communications technology. One illustrated embodiment includes multiple wireless antennas allowing an automatic and/or the user-initiated switch between WiFi (802.11) and Motorola Canopy (900 MHz). The product allows for the geographical extension of a current network for customers who have a limited broadband access radius. For customers needing access or those needing to augment access, the antenna aiming system 10 provides a solution to both problems. Additionally, once access is achieved, the antenna aiming system 10 can extend that access to remote locations by finding the target (automatically aiming the antenna at the access point), establishing a broadband wireless network connection, optimizing the access signal while maintaining the network session, and tracking the target or access point to continuously provide wireless access to the moving vehicle or vessel.

An illustrated embodiment of the antenna aiming system 10 supports WiFi (2.4 GHz) networks. WiFi is a widely used, inexpensive technology that can easily be extended to distances beyond 5 miles. The system may also include different and/or multiple communication options (antennas) such as 802.16 (WIMAX), 802.20, 900 MHz or 5.x GHz frequency ranges to accommodate other emerging wireless communication technologies.

Marine Performance Testing

Figure 5:
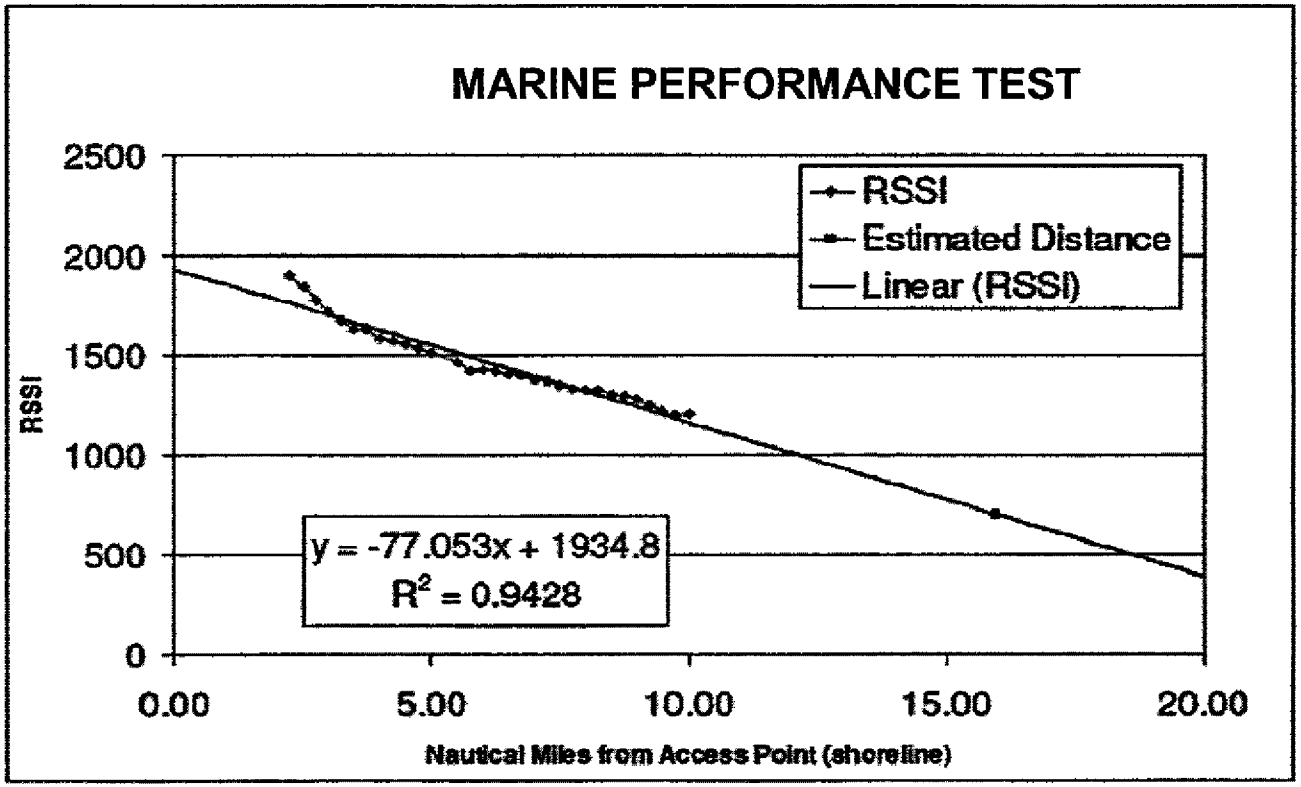
FIGS. 5 and 6 are graphs illustrating test results of the antenna aiming system.

The auto-aiming antenna system 10 was evaluated based on signal strength and quality over water at 900 MHz. The performance test involved placing the auto-positioning antenna on the stern of a 47' Coast Guard vessel on Lake Michigan approximately 7 feet above sea level. The antenna was linked to an access point positioned on a large sand dune approximately 100 feet above sea level. The results of this test are included as a plot of the RSSI (relative signal strength intensity) at periodic distances from the shoreline as shown in FIG. 5. Note that the data points beyond 5 miles demonstrate a linear relationship between decreasing RSSI over distance, which can be extrapolated to connectivity as far as 22.5 miles if signal "jitter" is reduced by elevating the prototype to 14' above sea level (or greater), which is the expected mounting height of the product on the top of the vessel's bridge. This extrapolation is based on known RSSI data where connectivity is maintained at an RSSI level above 700.

Terrestrial Performance Testing

Figure 6:
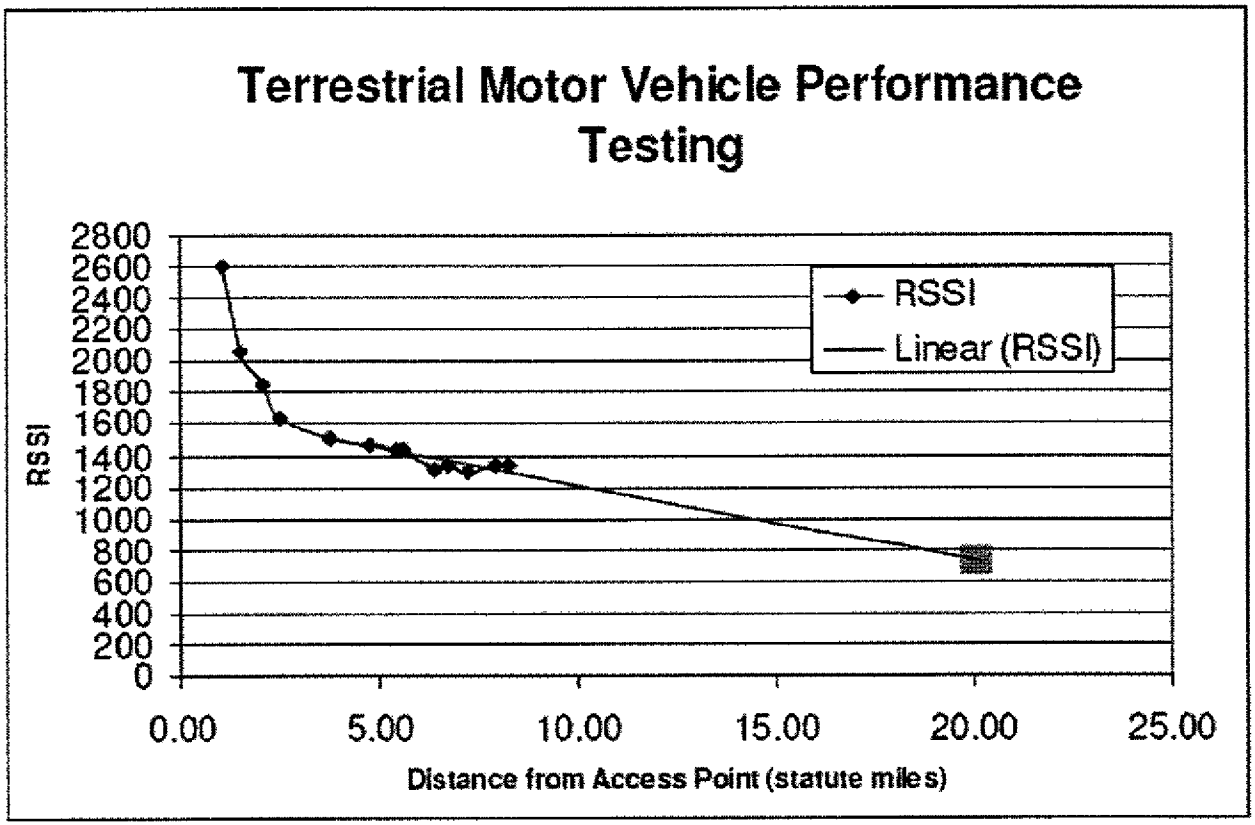

The auto-aiming antenna system 10 was also evaluated based on signal strength and quality over a rural landscape at 900 MHz. The performance test involved placing the auto-positioning antenna system 10 on the top of a moving vehicle approximately 7 feet above the ground. The antenna was linked to an access point positioned on an agricultural building approximately 85 feet above the ground. The results of this test are illustrated as a plot of the RSSI (relative signal strength intensity) at periodic distances from the access point as shown in FIG. 6. Note that the data points beyond 3.5 miles demonstrate a linear relationship between decreasing RSSI over distance, which can be extrapolated to connectivity as far as 20 miles if signal "jitter" is reduced by elevating the prototype to 14' above the ground (or greater), which is the expected mounting height of the product on the top of an agricultural tractor or similar farm equipment. This extrapolation is based on known RSSI data where connectivity is maintained at an RSSI level above 700

In summary, there are various embodiments in which the automatic antenna aiming system 10 of the present invention may be used. In one illustrated embodiment, two stationary antenna locations configured in a point-to-point backhaul configuration. In this embodiment, antennas are located at remote locations such as on top of a building and/or on a tower. In this embodiment, both antennas are equipped with an automatic aiming control systems 10 as described herein.

In another illustrated embodiment, an antenna on a tower communicates with an omni-directional antenna on a low speed mobile unit such as a tractor. As discussed above, a functional connection can be made with manned or unmanned vehicles that are in constant or occasional motion including but not limited to sea faring, aviation, terrain, recreation, agriculture and military vehicles.

In yet another illustrated embodiment, an omni-directional antenna is located on a tower. The omni-directional antenna communicates with an auto-aiming antenna located on a low mobility vehicle, such as a boat or motor vehicle, which needs to be tracked from a distance as the vehicle moves. In this embodiment, the vehicles may also be equipped with a GPS system which provides a feedback signal into the antenna aiming system to predict movement of the vehicle to assist with aiming the antenna.

In still another illustrated embodiment, an omni-directional or auto-aiming antenna is located on a tower in communication with a high speed vehicle such as an aircraft. Multiple towers and auto-aiming antennas are typically used to communicate with the aircraft.

In a further illustrated embodiment, the auto antenna aiming system 10 is used as a relay station or repeater. In this embodiment a first antenna aiming system 10 receives information from a first wireless communication device 16. The received information is passed to a second antenna aiming system 10 which transmits the information received by the first antenna aiming system 10 to a second wireless communication device 16. The first and second antennas typically operate at different frequencies or channels. Each antenna has the independent ability to aim, acquire and track an outlying station.

Border Security System

Figure 7:
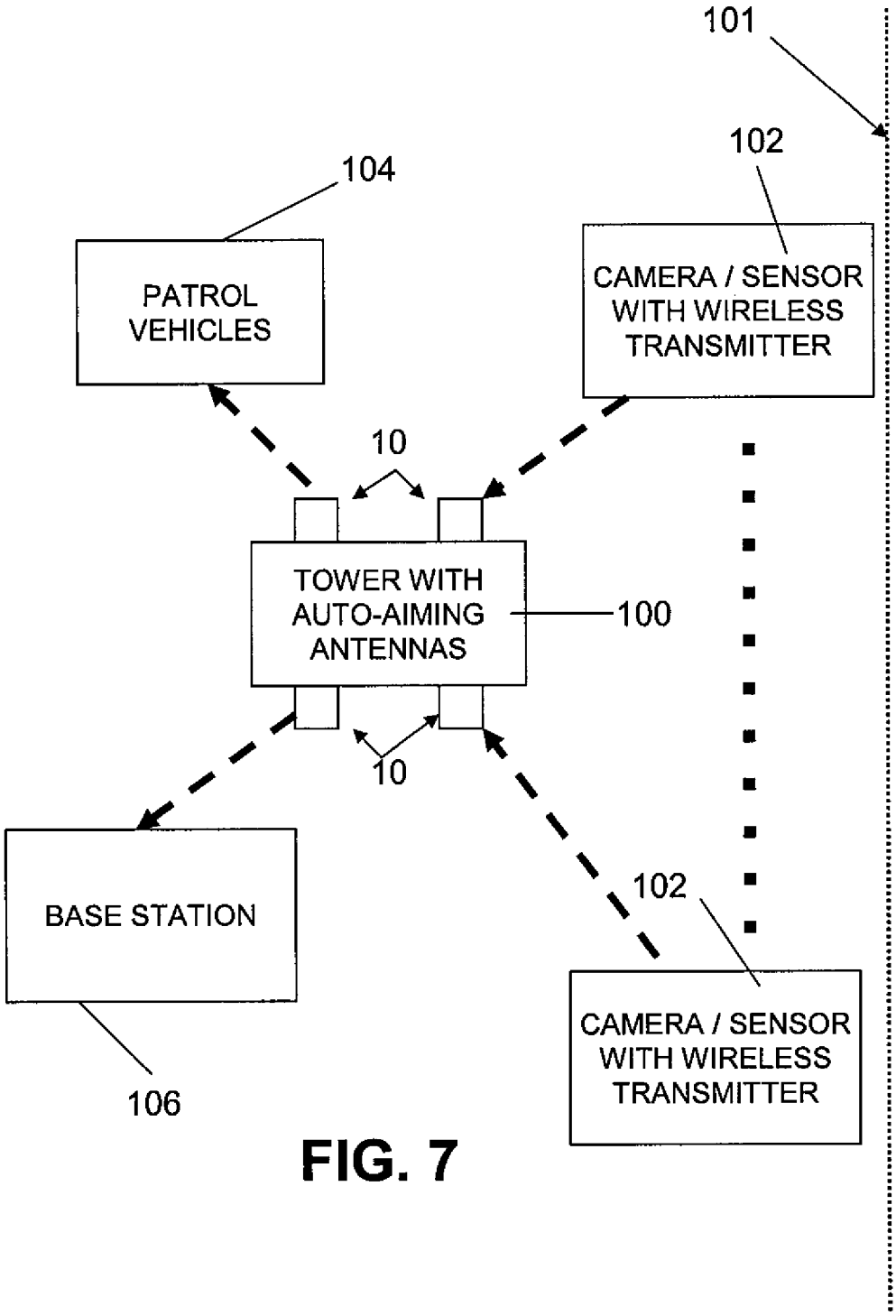
FIG. 7 is a block diagram illustrating a border security application of the present invention.

The utilization of the antenna aiming system 10 within a secure network may be used to provide an extended, remote surveillance system applicable to border security. In an illustrated embodiment, multiple antenna aiming systems 10 are positioned on a 75'-100' tower 100 approximately 5-20 miles from border 101. Each auto-aiming antenna device communicates with a plurality of remote cameras and sensors 101 positioned along a 15-20 mile length of the border as shown in FIG. 7. In addition, an antenna aiming system 10 is mounted on each patrol vehicle 104 thereby allowing security personnel in the vehicles to view (real-time) camera and sensor data from anywhere along the border at any time. Finally, all security base stations 106 in the region or agency office across the nation have secured access to the wireless monitoring system along the border.

The auto-aiming antennas locate the wireless remote camera and sensors 102 positioned along the border 101. Signals from the cameras/sensors 102 can be accessed by the network at any time. In addition, the remote cameras/sensors 102 may include on-board image and data analysis software to trigger high-priority communications within the wireless network if a threat is detected. A detected threat triggers wireless communication, which sends streaming video (and any other sensor data) through the network that is immediately available to both security offices at the base station 106 and security personnel in patrol vehicles 104 (using a laptop computer). This capability allows nearly instantaneous threat assessment.

In operation, the border security system provides a plurality of antenna aiming devices 10 located about 5 to about 20 miles from the border which are illustratively on a 75-100 foot tower 100. In an illustrated embodiment, the antennas are solar powered. The antenna aiming system 10 continuously monitors the plurality of cameras and sensors 102 spaced along the border 101. Illustratively, the auto aiming antenna 10 on tower 100 scans the plurality of camera/sensors in about 3-5 second scan cycles. Other antenna aiming systems 10 on tower 100 maintain broadband wireless communication links with moving patrol vehicles 104 and base station 106.

The remote camera/sensors 102 continuously operation to detect unauthorized activity along the border even when no network session is active. For instance, on board thermal imaging sensors, motion sensors and image analysis software can detect movement and analyze the image signal to determine the type of image. The software can distinguish between a person and an animal or the like. If a high priority image is detected, such as a person running toward the camera 102, the camera/senor 102 transmits a wireless signal which is detected by the auto aiming system 10 on tower 100. Video images and data are then automatically transmitted from the camera/sensor 102 to the auto antenna aiming system 10 through the wireless network. These image signals are then forwarded from the other antenna aiming systems 10 on tower 100 to patrol vehicle 104 and base station 106. Patrol vehicle 104 and base station 106 can also send signals to access a particular camera or sensor 102 at any time. The vehicle 104 or base station sends a request to the aiming system 10 on tower 100 which then establishes a communication link with the particular camera/sensor 102 at the desired location and obtains the image signal from that camera 102.

Although the invention has been described in detail with reference to certain illustrated embodiments, variations and modifications exist within the spirit and scope of the invention as defined in the following claims.

What is claimed is:

1. A method for automatically aiming an antenna to locate a signal transmitted by a remote broadband wireless communication network device and then initialize and maintain a functional two-way network communication session with the remote broadband wireless communication network device, the method comprising:

automatically moving the antenna along a path to search for a signal transmitted by the broadband wireless communication network device before establishing a network communication session between the antenna and the broadband wireless communication network device;

automatically determining a signal quality value of the signal transmitted by the broadband wireless communication network device and received by the antenna at a plurality of different locations as the antenna is moved along the path;

automatically storing the determined signal quality values and associated antenna coordinates at the plurality of different locations as the antenna is moved along the path;

automatically selecting an optimal antenna position based on the stored signal quality values and the associated antenna coordinates;

automatically positioning the antenna at the selected optimal antenna position;

establishing a two-way network communication session between the antenna and the remote broadband wireless communication network device positioned at the optimal antenna position;

automatically determining whether a trigger event has occurred after the two-way network communication session is established;

automatically moving the antenna along an optimization scan path in an area adjacent the optimal antenna position upon occurrence of the trigger event while maintaining the two-way network communication session;

automatically determining a signal quality value of a signal transmitted by the broadband wireless communication network device and received by the antenna at a plurality of different locations along the optimization scan path;

automatically determining whether a new optimal antenna position exists based the signal quality values determined as the antenna moves along the optimization scan path; and automatically moving the antenna to the new optimal antenna position upon determining that a new optimal antenna position exists to optimize the two-way network communication session;

wherein the trigger event occurs when the signal quality value of the signal received by the antenna from the broadband wireless communication network device decreases below a threshold value; and wherein a rate of movement along the optimization scan path and a dimension of the optimization scan path adjusted is based upon at least one of how fast the signal quality value is decreasing and how far the antenna is from the remote broadband wireless communication network device.

2. A system for automatically aiming an antenna to locate a signal transmitted by a remote broadband wireless communication network device and then initialize and maintain a functional two-way network communication session with the remote broadband wireless communication network device, the system comprising:

an antenna;

a drive mechanism coupled to the antenna;

a controller coupled to the drive mechanism, the controller being configured to actuate the drive mechanism automatically to move the antenna along a path to search for a signal transmitted by the broadband wireless communication network device before establishing a network communication session between the antenna and the broadband wireless communication network device; and software stored in a memory for execution by the controller, the software including a first processing sequence for automatically determining a signal quality value of the signal transmitted by the broadband wireless communication network device and received by the antenna at a plurality of different locations as the antenna is moved along the path, a second processing sequence for automatically storing the determined signal quality values and associated antenna coordinates at the plurality of different locations as the antenna is moved along the path, a third processing sequence for automatically selecting an optimal antenna position based on the stored signal quality values and the associated antenna coordinates, a fourth processing sequence for automatically positioning the antenna at the selected optimal antenna position, a fifth processing sequence for establishing a two-way network communication session between the antenna and the remote broadband wireless communication network device positioned at the optimal antenna position, a sixth processing sequence for automatically determining whether a trigger event has occurred after the two-way network communication session is established, a seventh processing sequence for automatically moving the antenna along an optimization scan path in an area adjacent the optimal antenna position upon occurrence of the trigger event while maintaining the two-way network communication session, an eighth processing sequence for automatically determining a signal quality value of a signal transmitted by the broadband wireless communication network device and received by the antenna at a plurality of different locations along the optimization scan path, a ninth processing sequence for automatically determining whether a new optimal antenna position exists based the signal quality values along the optimization scan path, and a tenth processing sequence for automatically positioning the antenna at the new optimal antenna position upon determining that a new optimal antenna position exists to optimize the two-way network communication session;

wherein a rate of movement along the optimization scan path and a dimension of the optimization scan path adjusted is based upon at least one of how fast the signal quality value is decreasing and how far the antenna is from the remote broadband wireless communication network device.

3. A method for automatically aiming an antenna to initialize and maintain functional two-way communication with a broadband wireless communication network device, the method comprising:

automatically moving a first antenna including a receiver along a scanning path to search for a signal transmitted by the broadband wireless communication network device;

using the first antenna to automatically determine an optimal antenna position by automatically monitoring a signal quality value of the signal transmitted by the broadband wireless communication network device and received by the first antenna at a plurality of different locations along the scanning path of the first antenna;

automatically positioning a second antenna including a receiver and a transmitter at the optimal antenna position determined by the first antenna, the first and second antennas being independently movable relative to each other;

establishing and maintaining a two-way network communication session between the second antenna positioned at the optimal antenna position and the broadband wireless communication network device while the first antenna continues to move along the scanning path independently from the second antenna to continue to monitor the signal quality value of the signal received from the broadband wireless communication network device at the plurality of different locations along the scanning path and automatically determine if the optimal antenna position has changed to a new optimal antenna position;

automatically positioning the second antenna at the new optimal antenna position if the optimal antenna position has changed to the new optimal antenna position; and automatically determining whether a trigger event has occurred after the two-way network communication session is established between the second antenna positioned at the optimal antenna position and the broadband wireless communication network device, and the step of automatically positioning the second antenna at the new optimal antenna position occurs after an occurrence of the trigger event.

4. The method of claim 3, wherein the trigger event occurs when the signal quality value of the signal from the broadband wireless communication network device received by the second antenna decreases below a threshold value.

* * * * *